United States Patent [19]

Ito

[11] 3,943,635

[45] Mar. 16, 1976

[54] GUIDE LINE TRACER

[75] Inventor: Hiroshi Ito, Osaka, Japan

[73] Assignee: Sakai Chemical Industry Co. Ltd., Japan

[22] Filed: July 19, 1973

[21] Appl. No.: 380,548

[30] Foreign Application Priority Data

July 26, 1972 Japan ..... 47-75655

[52] U.S. Cl. ..... 33/264; 33/185 V; 33/192

[51] Int. Cl.[2] ..... G01C 15/00

[58] Field of Search ..... 33/264, 185 V, 190, 192

[56] References Cited

UNITED STATES PATENTS

| | | | |
|---|---|---|---|
| 1,346,646 | 7/1920 | Gallagher | 33/192 |
| 2,198,864 | 4/1940 | Degrelle | 33/264 |

*Primary Examiner*—William D. Martin, Jr.

*Attorney, Agent, or Firm*—Toren, McGeady and Stanger

[57] ABSTRACT

The invention provides a guide line tracer adapted to be mounted forwardly of a line marker for marking lines on the road surface. Said guide line tracer comprises a pantograph link mechanism capable of extension and contraction through a remote control system whereby when not in use, it can be contracted to the shortest length but when in use, it can be selectively extended so as to permit the indicator to be always disposed in the most suitable position for an operator to look at.

The invention further dissolves the problems of deadening the vibrations of the indicator so as to induce the indicator to trace exactly along a guide line.

9 Claims, 7 Drawing Figures

GUIDE LINE TRACER

The present invention relates generally to improvements in a guide line tracer in use with a line marking car for marking a road indication or demarcation line on a road surface, and more particularly it relates to a particular guide line tracer adapted to guide the line marking car along a guide line mark on a road surface and a pavement surface section on along an old line mark.

For the purpose of marking on a road surface a section line such as a center line, a lane line or no-passing line, it is customary to employ a line marking car (hereinafter called "a line marker") adapted to follow a guide line marked on the road surface by use of a guide line tracing means thereby making it possible to paint the road surface portion with a white or yellow line along said guide line.

Referring to the conventional guide line tracers, they are constructed, as shown for example in FIG. 5 of the accompanying drawings, with a main body 1 comprising a rectilineal extension of a steel material having forked roots each pivoted to the front portion of a line marker 5 in upwardly and downwardly movable relationship therewith, and foremost end of said guide line tracer is provided with a caster wheel 3 and an indicator 4.

Due to the above-mentioned construction, the main body 1 cannot be free of the vibrations incessantly transmitted thereto from the caster wheel 3 jolting on the uneven road surface and also from a motor rigidly fixed on the line marker so that the main body 1 is always subjected to the vertical and lateral vibrations of small amplitude.

In addition, these vibrations transmitted to the main body 1 are resonant with the natural vibration of said main body per se to result in causing a great resonance phenomenon. Thus the indicator 4 is subjected to the resonance thereby making it difficult for an operator to look at the indicator 4 and at the same time drive the line marker along a guide line 6 in order to draw a desired line such as a section line accurately on the road surface along the guide line 6.

With the view to eliminating or mitigating the above-mentioned drawbacks and disadvantages of the conventional line markers, a proposition has been made to employ a chain or a steel wire in place of the caster wheel 3 so as to support the main body 1 on a line marker.

Even in this case, however, the main body 1 cannot still be free of the vibrations transmitted thereto by all the rotatable elements of a motor rigidly mounted on the line marker, thus making it impossible not only to prevent the indicator from being vibrated but also to control the vibration of the main body in order to prevent this vibration to be resonant with the former vibrations. The result is that the above-mentioned drawbacks still go with the line markers in spite of the fact that the caster wheel is not employed.

Further, inasmuch as most of all the above-mentioned conventional line markers are constructed with a rectilineal extension made of a steel material extending forwardly of a line marker, an operator must take the trouble of raising the main body upwardly thereby to keep it in a substantially erected posture on removing it from the line marker each time he intends to change the driving direction of the line marker or when he drives the line marker to the site of line marking operation, consequently bringing about an additional disadvantage that a three-dimensionally large room is necessitated for accommodating the line marker for preservation.

Accordingly, the present invention has been designed to eradicate all the above-mentioned drawbacks and disadvantages of the conventional line markers, having as one of its main objects the provision of a guide line tracer adapted to prevent the vibrations of a line marker from being transmitted to the forward portion of the guide line tracer and also the resonant vibration therewith.

It is another object of the invention to provide a guide line tracer adapted to be selectively extensible and contractible through an operator's light touch operation in his seated posture thereby enabling him not only to easily change the driving direction of the line marker but also to effectively accommodate the line marker in a relatively small spatial room.

It is a further object of the invention to provide a guide line tracer through which the main body, when extended, can be stably held in any position.

These and other objects, features and advantages of the present invention will become apparent from the following detailed description and the appended claims when taken in conjunction with the accompanying drawings showing a preferred embodiment of the invention, in which:

Figure 1:
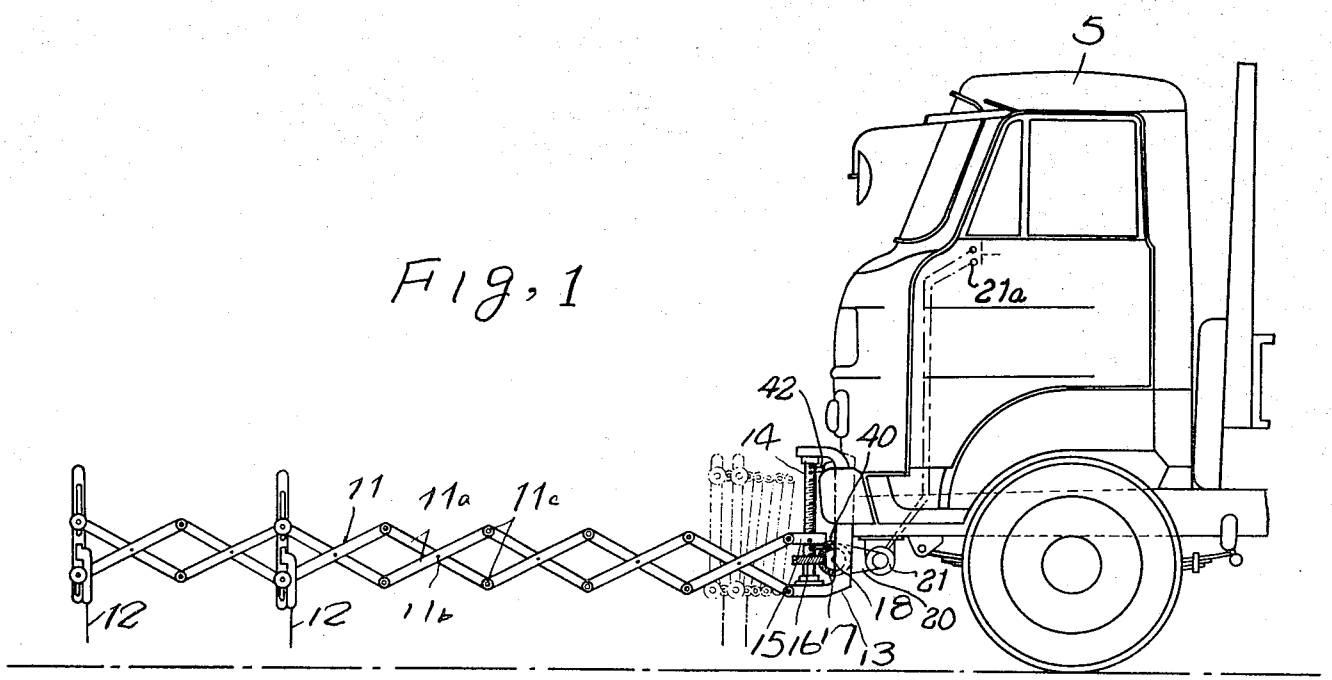
FIG. 1 is a side elevation view showing a guide line tracer of the invention mounted on a line marker.

Referring now to the guide line tracer of the present invention in connection with the accompanying drawings, and first more particularly, the reference numeral 11 designates a main body of a guide line tracer embodying the present invention.

Said main body 11 comprises a plurality of link members 11a, each pair of which are pivoted in the center thereof to a short shaft 11b, and further each end of which is pivoted by means of a long shaft 11c thereby, as the whole, forming a pantograph type guide line tracer.

Figure 2:
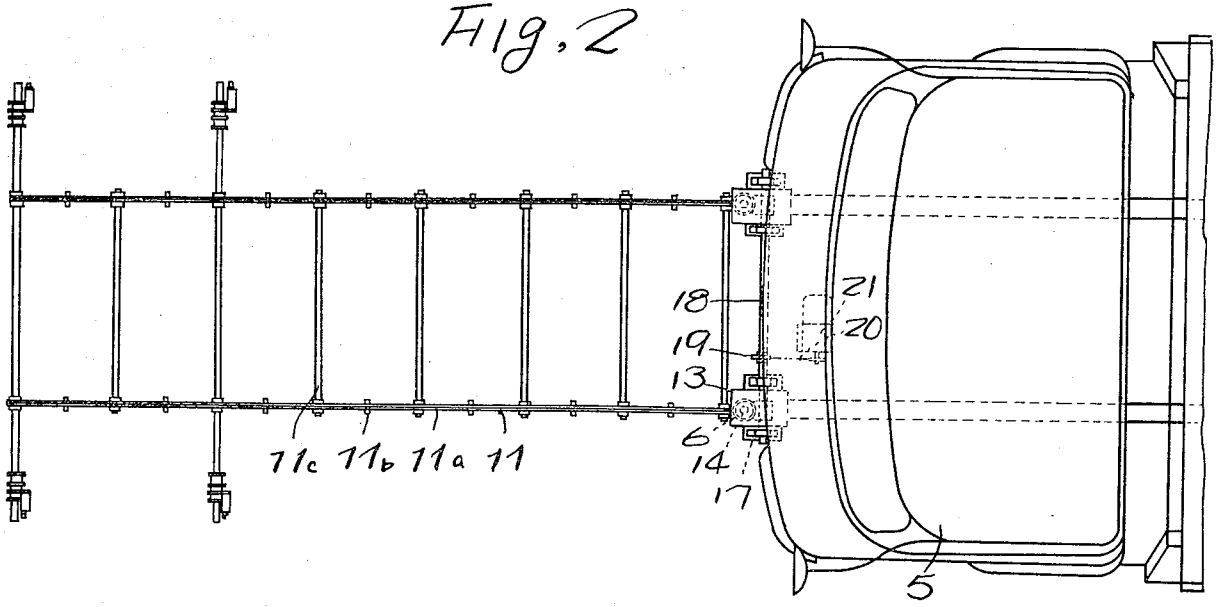
FIG. 2 is a surface view thereof.

Incidentally, said pantograph type mechanism comprises each pair of pantographic extension members connected to one another through said long shaft 11c shown in FIG. 2. The root portion of the main body 11 thus formed is mounted to the front of a line marker in extensible and contractible relation thereto by use of a fixture means. Then an indicator 12 is fitted to said long shaft 11c disposed forwardly of the main body 11 mounted forwardly of the line marker in a manner that said pantographic mechanism can be selectively extended and contracted through a subsequently described operating means by an operator seated in a driving room as is clearly shown in FIG. 1.

For a fuller understanding, forwardly of said line marker 5 there is rigidly fixed a mounting means that comprises a supporting member 13 of a substantially reverse C shape with respect to FIG. 1 of the accompanying drawings; Between the horizontal or parallel upper and lower portions of said supporting members 13 there is screwably mounted a screw shaft 14 having an outer periphery engraved with a screw thread so as to form an operating means.

In this case, said lower link member 11a disposed downwardly of the root portion of said main body 11 is pivoted to the lower horizontal portion of said supporting member 13 while said upper link member 11*a* is screwably engaged with said screw shaft 14 thereby to be mounted on a female screw 15 in up and down movable relation thereto. Then a worm wheel 16 is rigidly fixed to said screw shaft 14 so as to be screwably engaged with a worm 17 rigidly fixed to a driving shaft 18.

Said driving shaft 18 is thereafter connected through a sprocket wheel 19 and a chain 20, as is shown in FIG. 2, to a electric motor 21 mounted forwardly of the line marker 5 thereby enabling an operator, by manipulation of switch means 21*a*, not only to actuate said motor 21 thereby to forcibly extend or contract the main body 11 but also selectively control the rotational rate of the motor 21 while he is seated in the driving room.

In the above-mentioned embodiment of the present invention, the construction of the guide line tracer for a line marker is such that an operator is only to switch on said electric motor 21 so as to forcibly drive the screw shaft 14. Consequently, both the link members 11a and the female screw 15 which is screwably engaged with said screw shaft 14 are caused to move downwardly, thus bringing about a result that the main body 11 contracted in such a position for example as shown in the dotted line with respect to FIG. 1 is extended to the position as shown in the solid line thereof. This operation of extending the main body 11 to said position can be readily ceased merely be switching off the electric motor 21 to bring the movement of the screw shaft 14 to a halt.

In addition, an operator is able to orient the indicator 12 in the most suitable position for him to look at in his seated posture by selectively adjusting the position wherein said movement of the screw shaft 14 is to be halted.

For the purpose of changing the operation course of the line marker 5 or contracting the main body 11 after the completion of the operation work, an operator has only to reversely rotate said electric motor 21 thereby easily accomplishing such purposes.

In this case, it is preferable that a safety limit switch means 40, 42 is mounted between the uppermost and downmost portions of said screw shaft 14 because, thanks to this mounting, the screw shaft is permitted to automatically make a halt.

Incidentally, the main body 11 is adapted, when it is necessary to contract the same, to move upwardly about the lower horizontal portion of the supporting member 13 so that the indicator 12 is caused to move upwardly from the road surface during the time when the line marker 5 is in operation.

Figure 7:
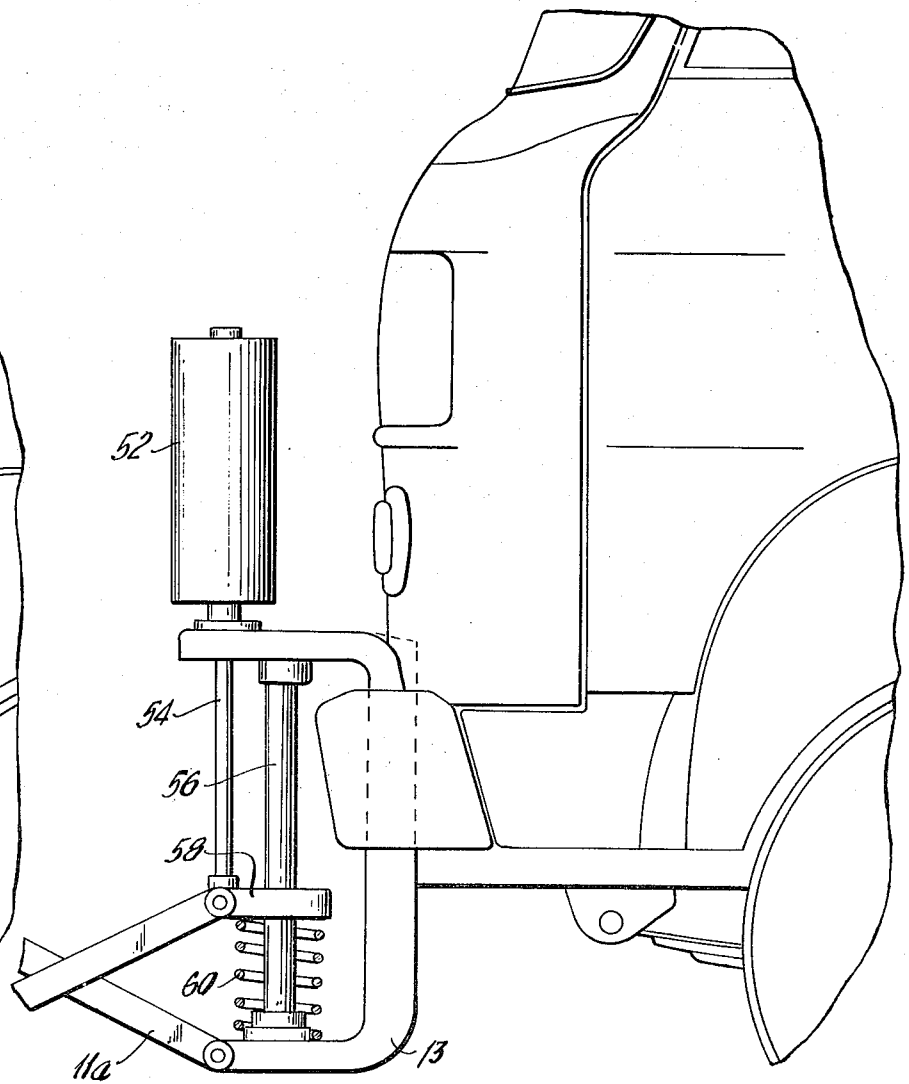
FIGS. 6 and 7 are front elevation views showing respectively, alternative embodiments of the invention.
Figure 6:
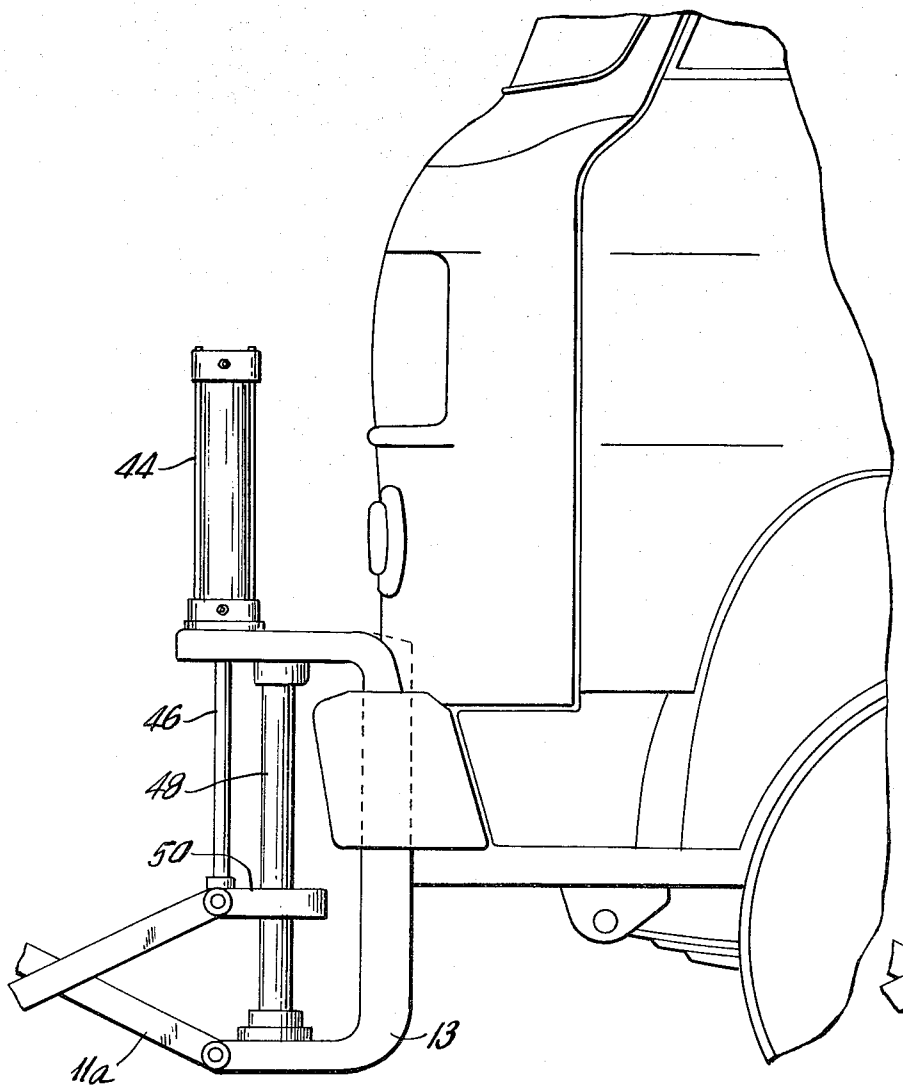

In order to control the extension and contraction of the main body 11 by means of a remote control system, the above-mentioned construction of the driving mechanism may be replaced with the construction wherein a suitable oil pressure apparatus including a hydraulic cylinder 44, a piston rod 46, a slide shaft 48, and a slider 50, shown in FIG. 6, is applied to hydraulically control the main body 11 or, alternatively wherein a suitable solenoid system including a solenoid 52, a rod 54, a slide shaft 56, a slider 58 and a spring 60 shown in FIG. 7, is employed to electrically control the same.

Further, in order to mechanically control the main body 11, particular threads are formed in opposed directions to one another on said uppermost and downmost ends of the screw shaft 14 thereby permitting said pair of link members 11*a* to be screwably engaged with the screw shaft 14. In this case, it is preferable that the supporting member 13 is fixedly mounted to the line marker 5 in vertically movable relation with respect thereto.

Figure 4:
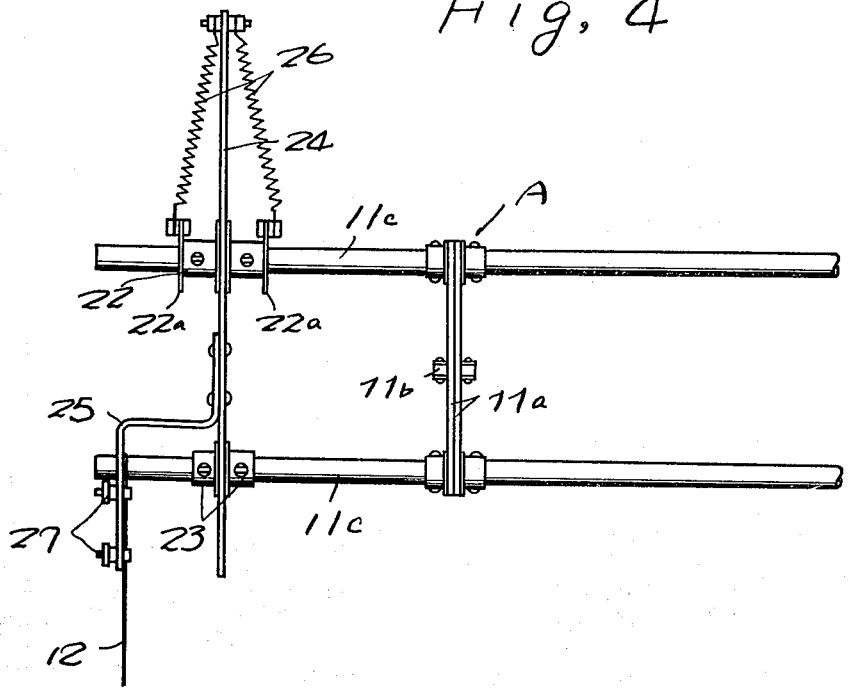
FIG. 4 is a front elevation view thereof with some parts omitted.
Figure 5:
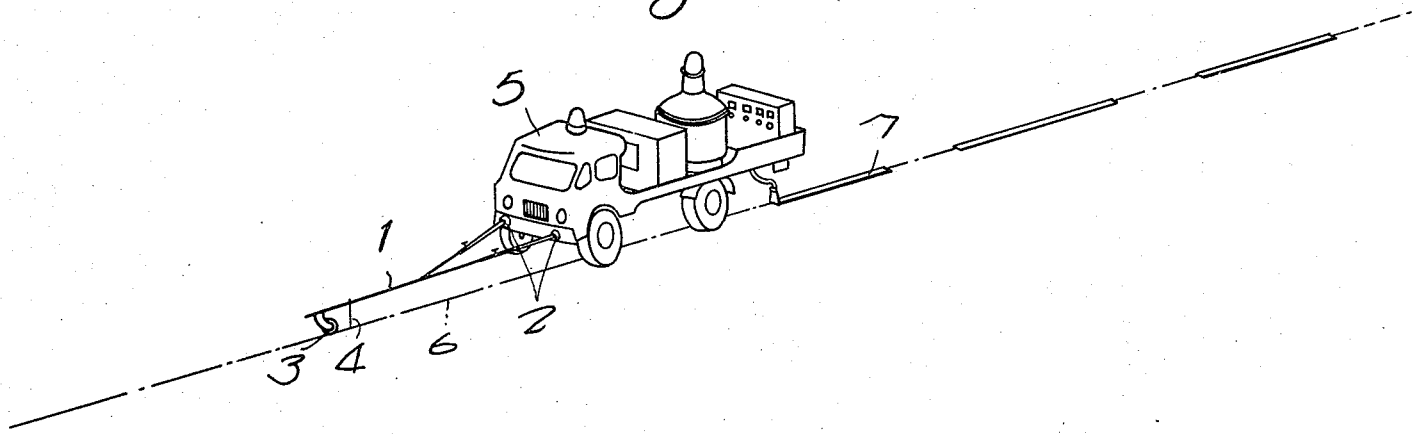
FIG. 5 is a schematically perspective view of the conventional guide line tracer.

Further, the indicator 12 is preferably mounted to the main body 11 by extending the long shaft 11*c* as is clearly shown in FIG. 4.

Namely, said pair of long shafts 11*c* which serve as pivots for connecting the ends of the link members 11*a* to each other and which form a linked portion A (shown in FIGS. 3 and 4) of the link mechanism are extended so as to form extensions to which each of stop collars 22, 23 is rigidly fixed. To said stop collars 22, 23 there is mounted a holding plate 24 bored with an upper guide slot 24*a* and a lower guide slot 24*b* which permit the plate to move in vertical relation with respect to the stop collars. A fixed plate 25 provided with the indicator 12 is rigidly fixed on said holding plate 24.

Figure 3:
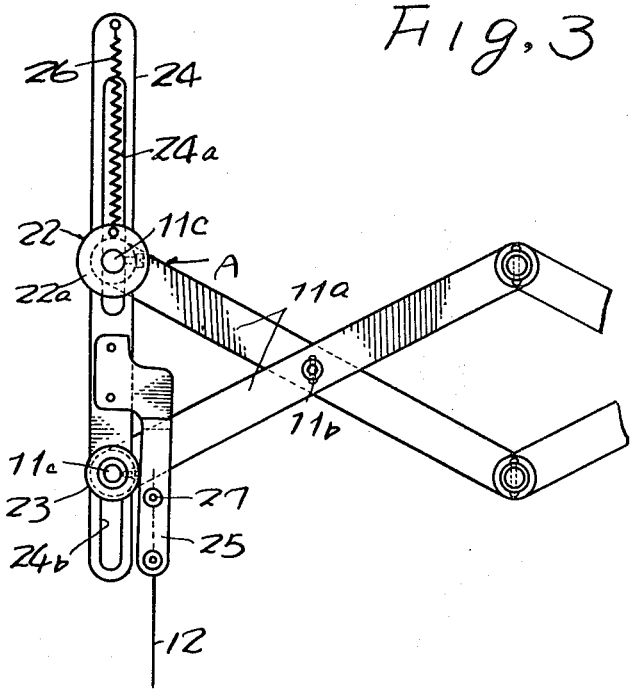
FIG. 3 is an enlarged view showing the portion of the guide line tracer wherein an indicator is mounted.

As shown in FIGS. 3 and 4, coil springs 26 are held between the upper portion of said holding plate 24 and a flange 22*a* of the collar 22 whereby said holding plate 24 is held downwardly to keep the upper surface portion of the long shaft 11*c* normally in contact with the upper edge of the lower guide slot 24*b;* The result is that said holding plate 24 is fixedly held in position whereby the link mechanism of the contracted main body 11, when extended through the full length, can still keep its configuration as it is.

Accordingly, due to the above-mentioned rigidly fixed state of the holding plate 24, the indicator 12 can also be held in a stationary state without being subjected to the vibrations which otherwise might be transmitted thereto from the line marker 5. Further by these coil springs 26, no vibration is caused to the link mechanism per se.

When the main body 11 thus formed is contracted, in the beginning, the upper long shaft 11*c* is moved upwardly along the guide slot 24a of the holding plate 24, and the upper surface of said shaft 11*c* comes into contact with the upper edge of the guide slot 24*a*, subsequently the holding plate 24 is forced up by the upper long shaft 11*c*, so that the upward movement of the holding plate 24 is brought to a halt in the position where the lower long shaft 11c contacts the lower edge of the lower guide slot 24*b*.

During the whole course of contracting the main body 11, the indicator 12 is kept raised to a height equal to the axial length of the lower guide slot 24*b* so that any damages can be obviated which otherwise might occur to the indicator when collided with protrudent obstacles lying on the road surface where the line marker 5 is operated to turn to a different direction or along which it is running.

The aforesaid type indicator 12 is detachably mounted on the holding plate 25 by means of a metallic fixture pin 27 having the same construction for example as that of a pair of drawing compasses. Said indicator 12 is preferably coated with either a white paint or a reflective paint so that an indicator of a suitable color paint can be selectively employed depending on the condition of line marking operations to be carried out during the daytime or the nighttime.

Further according to the present invention, a pair of pantograph type link mechanism may preferably be employed in such a manner for example as is illustrated in the accompanying drawings wherein said pair are disposed at a regularly spaced apart interval with one another. By this arrangement, the guide line 6 can be easily pursued by an operator from both sides of the line marker 5 in his seated posture. However, the link mechanism may of course be formed with a single unit.

According to the guide line tracer of the present invention, the vibrations caused by a running line marker and the driving portions of an motor mounted thereon would be transmitted to most slightly to the portion where said guide line tracer is mounted to the line marker so that the forward portion of the guide line tracer is hardly subjected to these vibrations. Further, due to the pantograph type mechanism, each of the link members forming the mechanism produces a different frequency of vibrations peculiar to each link member so that no resonance is caused among all the link members. Thus the indicator 12 mounted forwardly of the guide line tracer can be led to trace exactly along the guide line without being subjected to any vibrations or swinging motions, thereby to permit the line marker 5 to paint a white or yellow line mark on the traced guide line.

Moreover, the guide line tracer of the present invention is composed of the above-mentioned pantograph type link mechanism designed to be easily contracted to the shortest length so that when an operator intends to turn the line marker to a different direction, drive it to a line marking site or house it into a garage, he needs not pull up the guide line tracer or remove it off the main body thereby not only enhancing the operational efficiency of the line marker but also permitting the line marker to be housed in a small spatial room.

In addition, the extension and contraction of the guide line tracer is readily controlled from an operating seat so that the indicator can be selectively adjusted to be disposed in the most suitable position for an operator to look at in correspondence to his seated posture and visual power. This has a result that an operator is able to pursue the guide line more exactly through this properly oriented indicator.

Moreover, being applicable to the holding means rigidly fixed to the pantograph type link mechanism which is stably supported, the indicator can be held in a stationary state thereby to enable an operator to pursue the marked guide line more exactly through the indicator.

According to the above-mentioned construction of the link mechanism it is further possible to raise the indicator together with the linked portions of the link mechanism when the latter is moved upwardly so that even in case to change the driving direction, the indicator is completely prevented from damages which otherwise may fall thereupon collided with protrudent obstacles lying on the road.

While I have disclosed a preferred embodiment of the invention and have indicated various changes, omissions and additions which may be made therein, it will be apparent that various other changes, omissions and additions may be made in the invention without departing from the scope and spirit thereof.

What I claim is:

1. Road guide line marking apparatus including a vehicle comprising pantographic support means including a pair of ends extending longitudinally from said vehicle and formed of a plurality of pivotally articulated link members operable to enable selective longitudinal extension and contraction of said support means; means mounting one end of said pantographic support means to said vehicle; indicator means mounted proximate the other end of said pantographic support means; and driving means operable to effect selective longitudinal extension and contraction of said pantographic support means.

2. Apparatus according to claim 1, wherein said vehicle includes a driver's compartment containing controls for operating said vehicle, said apparatus further including means located to enable control of said driving means from within said driver's compartment.

3. Apparatus according to claim 2;

wherein said one end of said pantographic support means is defined by ends of a terminal pair of said articulated link members, said link member ends moving toward and away from each other upon extension and contraction, respectively, of said pantographic support means;

wherein said driving means include a rotatable threaded shaft, screw means threadedly engaging said shaft for movement longitudinally thereof upon rotation of said shaft, and means for rotatably driving said shaft; and wherein said mounting means include means pivotally mounting one of said terminal link member ends to said vehicle and the other of said link member ends to said screw means.

4. Apparatus according to claim 3, wherein said driving means include an electric motor, gear means connected to impart a driving force from said electric motor to said threaded shaft to effect rotation thereof, and switch means mounted within said driver's compartment of said vehicle to control operation of said electric motor.

5. Apparatus according to claim 1, wherein said pantographic support means include at least a pair of link members proximate said other end of said support means having a pair of ends movable toward and away from each other with expansion and contraction, respectively, of said support means, said apparatus further including a holding plate having a pair of elongated slots defined therein, means mounting said indicator means upon said holding plate, pin means affixed to each of said ends of said link members, each of said pin means extending, respectively, in sliding engagement through one of said slots, and spring means extending between one of said pin means and said holding plate to urge said one pin means in one direction within its respective slot, said slots being formed of a length sufficient to enable sliding movement of said pin means therein when said link member ends are moved together or apart by expansion and contraction of said pantographic support means.

6. Apparatus according to claim 1, wherein said pantographic support means comprise a pair of pantographic link mechanisms each comprising a plurality of said pivotally articulated link members, said link mechanisms being interconnected in a spaced apart generally parallel arrangement to expand and contract concurrently relative to said vehicle.

7. Apparatus according to claim 3, including limit switch means for sensing location of said screw means at a pair of opposed terminal positions on said threaded shaft and for controlling operation of said means for rotatably driving said shaft to limit movement of said screw means to between said terminal positions.

8. Apparatus according to claim 1, wherein said one end of said pantographic support means is defined by ends of a terminal pair of said articulated link members, said link member ends moving together and apart upon expansion and contraction, respectively, of said pantographic support means, said driving means comprising hydraulic cylinder means operable to drive said link member ends together and apart to effect expansion and contraction, respectively, of said pantographic support means.

9. Apparatus according to claim 1, wherein said one end of said pantographic support means is defined by ends of a terminal pair of said articulated link members, said link member ends moving together and apart upon expansion and contraction, respectively, of said pantographic support means, said driving means comprising solenoid means operable to drive said link member ends together and apart to effect expansion and contraction, respectively, of said pantographic support means.

* * * * *